US007158128B2

(12) United States Patent
Fujino et al.

(10) Patent No.: US 7,158,128 B2
(45) Date of Patent: Jan. 2, 2007

(54) DRIVE UNIT AND DISPLAY MODULE INCLUDING SAME

(75) Inventors: Hiroaki Fujino, Nara (JP); Michihiro Nakahara, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 201 days.

(21) Appl. No.: 10/172,972

(22) Filed: Jun. 18, 2002

(65) Prior Publication Data

US 2003/0043126 A1 Mar. 6, 2003

(30) Foreign Application Priority Data

Aug. 28, 2001 (JP) ..... 2001-257449

(51) Int. Cl.
*G09G 3/36* (2006.01)

(52) U.S. Cl. ..... 345/204; 345/87; 345/98; 345/100

(58) Field of Classification Search ..... 345/87–102, 345/690

See application file for complete search history.

(56) References Cited

U.S. PATENT DOCUMENTS 5,734,378 A * 3/1998 Okada et al. ..... 345/204
5,856,816 A * 1/1999 Youn ..... 345/98
6,229,513 B1 * 5/2001 Nakano et al. ..... 345/99
2002/0080107 A1 * 6/2002 Fujimoto et al. ..... 345/87

FOREIGN PATENT DOCUMENTS

| | | |
|---|---|---|
| JP | 06-95618 | 4/1994 |
| JP | 10-161600 | 6/1998 |
| JP | 2000-305530 | 11/2000 |

* cited by examiner

*Primary Examiner*—Richard Hjerpe
*Assistant Examiner*—Duc Q Dinh
(74) *Attorney, Agent, or Firm*—Birch, Stewart, Kolasch & Birch, LLP

(57) ABSTRACT

A data latch circuit in a source driver has delayed flip-flops (DFFs) which receive display data signals R·G·B, in synchronism with respective rising and falling edges of a clock signal SCK having a half frequency of the display data signals R·G·B. Furthermore, the OFFs independently output to a sampling memory circuit the display data signals R·G·B received in synchronism with the rising edge of the clock signal SCK and the display data signals received in synchronism with the falling edge of the clock signal SCK.

7 Claims, 9 Drawing Sheets

TIMING CHART IN TWO-PORT SINGLE EDGE MODE

TIMING CHART IN DUAL EDGE MODE

DRIVE UNIT AND DISPLAY MODULE INCLUDING SAME

FIELD OF THE INVENTION

The present invention relates to a drive unit for driving a display module in accordance with display data signals that have been subjected to digital/analog conversion, and to a display module including the same.

BACKGROUND OF THE INVENTION

As shown in FIG. 6, in an arrangement example of a conventional display module, a plurality of source drivers 100 and gate drivers 200 composed of an LSI (Large Scale Integrated Circuit), which are mounted on TCPs (Tape Carrier Packages) 300, are mounted on a liquid crystal panel 400 and a flexible substrate 500 as source drivers S and gate drivers G. Note that, the TCP is a generic name of a thin package in which an LSI element is supported by being pasted with a tape film and the like.

The plurality of source drivers S drive source bus lines (not shown) on the liquid crystal panel 400, whereas the plurality of gate drivers G drive gate bus lines (not shown) on the liquid crystal panel 400.

Furthermore, a terminal group of the source drivers S and the gate drivers G on a side of the liquid crystal panel 400 are electrically connected to a terminal group (not shown) composed of ITO (Indium Tin Oxide) on the liquid crystal panel 400 via wiring formed on the TCPs 300. These terminal groups are electrically connected by means of, for example, thermo-compression bonding via an ACF (Anisotropic Conductive Film).

On the other hand, a terminal group of the source drivers S and the gate drivers G on a side of the flexible substrate 500 are electrically connected to wiring provided on the flexible substrate 500 via the wiring formed on the TCPs 300, by means of the ACF or soldering.

As described above, a controller circuit 600 supplies display data signals (three kinds of signals of R·G·B) to the source drivers S, and supplies kinds of control signals or power supplies (GND, VCC) to the source drivers S and the gate drivers G via the wiring on the flexible substrate 500 and the wiring on the TCPs 300.

By the way, in the arrangement example shown in FIG. 6, a total of eight source drivers S are provided, namely a first source driver (1) through an eighth source driver S(8). On the other hand, a total of two gate drivers G are provided, namely a first gate driver G(1) and a second gate driver G(2).

The first source driver S(1) through the eighth source driver S(8), having an identical arrangement, receive the display data signals R·G·B, a start pulse signal SSPI, and a clock signal SCK, which are respectively outputted from the controller circuit 600. On the other hand, the first gate driver G(1) and the second gate driver G(2), having an identical arrangement, receive a clock signal GCK, and a start pulse signal GSPI from the controller circuit 600.

FIG. 7 shows an enlarged view of the controller circuit 600 which outputs kinds of signals. When the liquid crystal panel 400 has 1024 pixels (the source side)×3 (R·G·B)×768 pixels (the gate side), for example, the first source driver S(1) through the eighth source driver S(8) respectively display $2^6$=64 tone gradations. Further, the first source driver S(1) through the eighth source driver S(8) respectively drive 128 pixels×3 (R·G·B).

Furthermore, as shown in FIG. 8, the source driver 100 includes a shift register circuit 110, a data latch circuit 120, a sampling memory circuit 130, a hold memory circuit 140, a reference voltage generating circuit 150, a DA converter circuit 160, and an output circuit 170. Note that, in the following explanation, it is assumed that the source driver 100 shown in FIG. 8 is the first source driver S(1) (see FIG. 6).

The shift register circuit 110 shifts the start pulse signal SSPI supplied to an input terminal SSPin, in synchronism with the clock signal SCK supplied to an input terminal SCKin of the source driver 100. Note that, the start pulse signal SSPI is a signal that is outputted from a terminal SSPI (see FIG. 7) of the controller circuit 600, and is synchronized with a horizontal synchronizing signal of the display data signals R·G·B. Further, the clock signal SCK is a signal outputted from an input terminal for the clock signal SCK (see FIG. 7) in the controller circuit 600.

Furthermore, the start pulse signal SSPI shifted by the shift register circuit 110 is transferred to a shift register circuit (not shown) in the eighth source driver S(8) of the eighth stage.

The data latch circuit 120 temporarily latches respective 6-bit display data signals R·G·B, which are serially sent respectively to input terminals R1in to R6in, input terminals G1in to G6in, and input terminals B1in to B6in, in synchronism with a rising edge of a signal/SCK, which is an inverted signal of the clock signal SCK, and then sends the respective 6-bit display data signals R·G·B to the sampling memory circuit 130. Note that, the display data signals R·G·B are signals which are outputted from terminals R1 to R6, terminals G1 to G6, and terminals B1 to B6 of the controller circuit 600.

The sampling memory circuit 130 samples the display data signals (a total of 18 bits of respective 6-bit R·G·B), which are sent in a manner of time division from the data latch circuit 120, and stores the respective display data signals until collecting the display data signals of a horizontal synchronization period. Then the respective display data signals are sent to the hold memory circuit 140.

The hold memory circuit 140 latches the display data signals, which are supplied from the sampling memory circuit 130, when the display data signals R·G·B of a horizontal synchronization period are collected in synchronism with a latch signal LS (a horizontal synchronizing signal). Furthermore, the hold memory circuit 140 holds the display data signals of one horizontal synchronization period until the next latch signal LS is supplied, and outputs the display data signals to the DA converter circuit 160 later described.

The reference voltage generating circuit 150 generates 64 levels of voltages, which are used for displaying tone gradations, by a resistance division circuit, for example, in accordance with a reference voltage which is outputted from terminals Vref 1 to Vref 9 (FIG. 7) of the controller circuit 600 and supplied to terminals Vref1 to Vref9 of the source driver 100.

The DA converter circuit 160 selects one of the 64 levels of voltages in accordance with the respective 6-bit display data signals (digital) of RGB supplied from the hold memory circuit 140. Thus, the conversion of a digital signal into an analog signal is carried out, and the analog signal thus converted is sent to the output circuit 170.

The output circuit 170 amplifies or converts to low impedance output, the analog signal selected by the DA converter circuit 160, and outputs the amplified or converted analog signal to the source bus line terminals (not shown) of the liquid crystal panel 400 via output terminals Xo-1 to Xo-128, Yo-1 to Yo-128 and Zo-1 to Zo-128. Note that, the output terminals Xo-1 to Xo-128, Yo-1 to Yo-128 and Zo-1 to Zo-128 respectively correspond to the respective display data signals R·G·B, and respectively have 128 terminals.

Furthermore, a terminal VCC and a terminal GND of the source driver 100 are provided for supplying power supplies, which are connected with the terminal VCC and the terminal GND of the controller circuit 600. The terminal VCC receives a power supply voltage, whereas the terminal GND receives a ground potential.

As described above, each of the source drivers 100 for displaying 64 tone gradations outputs the analog voltage to the liquid crystal panel 400 in accordance with the display data signals, thereby displaying 64 tone gradations. Note that, the gate driver 200 basically has a same arrangement as the source driver 100, thus their explanation is omitted here.

Furthermore, a technique is generally known for improving timing of receiving the display data signals as explained below.

Namely, as shown in FIG. 9, two systems (two ports) of the input terminals for the 6-bit display data signals R·G·B are provided as RA1in to RA6in, GA1in to GA6in and BA1in to BA6in, as well as RB1in to RB6in, GB1in to GB6in, and BB1in to BB6in, and the display data signals are separated into odd number data and even number data. Then the separated display data signals are received in synchronism with a rising edge or a falling edge of the clock signal having an identical frequency with the display data signals which are separated into two systems. This reduces a frequency of the clock signal for receiving the display data signals, thereby improving the timing of receiving the display data signals.

However, as a recent display module has a larger screen and a higher definition, following problems occur.

For example, the source driver for displaying 64 tone gradations requires a total of 18 data (6 bits×R·G·B) corresponding to RGB. 1024×768 pixels of XGA (extended graphics array) panel receives display data signals having a quite high frequency of 65 MHz. 1280×102 pixels of SXGA (super extended graphics array) having higher definition receives display data signals having a higher frequency of 95 MHz.

For this reason, when an image is to be displayed in higher definition, the sampling memory circuit is required to quickly store in a manner of time division the display data signals having such a high frequency as described above, after having been latched by the data latch circuit. However, when data having a high frequency is received in synchronism with the display data signals, a problem occurs that it becomes difficult to set the timing of receiving data (a data setup/hold time).

Furthermore, it becomes difficult to obtain a sufficient duty ratio (a ratio of a high period to a low period) of the data transfer clock in the source driver, thereby causing a problem of degrading image quality.

Note that, in a technique to separate the display data signals into two ports as shown in FIG. 9, a method can be considered to increase the number of ports for separating so as to respond to the display data signals having a higher frequency.

However, wiring required for the respective separated ports enlarges the source driver, and thus increases a size of the flexible substrate, thereby causing a problem that the display module becomes larger.

SUMMARY OF THE INVENTION

In view of the foregoing conventional problems, an object of the present invention is to provide a small drive unit, which has high reliability in display image quality, with respect to display data signals having a higher frequency, and to provide a display module including the same.

In order to solve the problems, a drive unit of the present invention, comprising (1) a data latch section for receiving inputted display data signals in synchronism with a clock signal and (2) a sampling memory section for storing the display data signals received by the data latch section, which drives a display module in accordance with the display data signals stored by the sampling memory section may be so arranged that the data latch section includes a data receiving section for receiving the display data signals in synchronism with respective rising and falling edges of the clock signal having a half frequency of the display data signals, and the data receiving section independently outputs to the sampling memory section (a) the display data signals received in synchronism with the rising edge of the clock signal and (b) the display data signals received in synchronism with the falling edge of the clock signal.

In other words, the drive unit of the present invention drives the display module based on the display data signals, which are received by the data latch section in synchronism with the clock signal.

As a recent display module is improved to have, for example, a larger screen or a higher resolution for an image, the display data signals having a higher frequency are inputted. Therefore, when the data latch section receives the display data signals in synchronism with the clock having the identical frequency with the display data signals, a duty ratio of the clock signal for receiving the data may needlessly decrease, thereby degrading image quality.

Therefore, a drive unit of the present invention, in particular, includes a data receiving section for receiving the display data signals in synchronism with the rising and falling edges of the clock signal having a half frequency of the display data signals, wherein the data receiving section independently outputs to the sampling memory section (a) the display data signals received in synchronism with the rising edge of the clock signal and (b) the display data signals received in synchronism with the falling edge of the clock signal.

According to the arrangement, even when the frequency of the display data signals are high, the clock signal for receiving the display data signals can be set to have a half frequency of the display data signals. This makes it easy to set timing of receiving the data.

Furthermore, the display data signals received in synchronism with the rising edge and the display data signals received in synchronism with the falling edge are independently sent to the sampling memory section. In other words, the frequency of the display data signals sent to the sampling memory section is as half as the frequency of the display data signals supplied to a first latch section.

Therefore, a duty ratio of the data transfer clock in the drive unit can be maintained at a sufficient ratio not to degrade the image quality.

Note that, a circuit configuration in the drive unit is modified to respond to the display data signals having a higher frequency, so that there is no need to increase the port number for separating the display data signals, thereby preventing the drive unit itself from becoming larger.

Therefore, it is possible to provide a small drive unit, having high reliability in the display image quality, with respect to the display data signals having a higher frequency.

Furthermore, in order to solve the problems, the display module of the present invention includes one of the drive units of the above arrangements.

According to the arrangement, the display module includes a drive unit having high reliability in the display image quality with respect to the display data signals having a higher frequency.

Therefore, it is possible to provide a display module that can display an image without degrading the image quality with respect to the display data signals having a higher frequency.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 through 5, an embodiment of the present invention is explained as follows.

Figure 4:
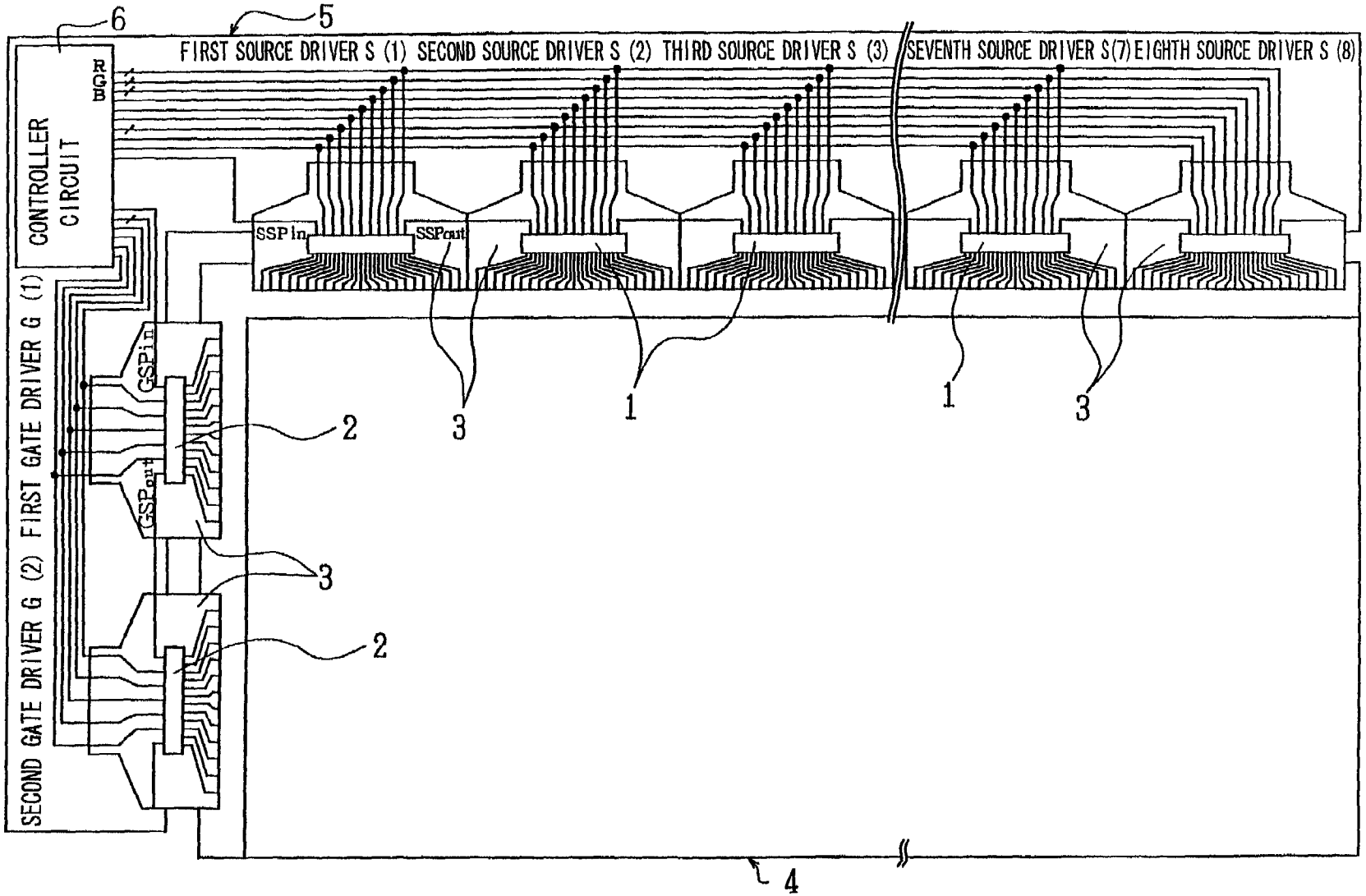
FIG. 4 is a circuit diagram showing an arrangement of a display module of the present invention.

As shown in FIG. 4, in a display module of the present embodiment, a plurality of source drivers (drive units) 1 and gate drivers (drive units) 2, which are mounted on TCPs 3, are mounted on a flexible substrate 5 and a peripheral section of a liquid crystal panel 4.

The plurality of source drivers 1 drive source bus lines (not shown) on the liquid crystal panel 4, whereas the plurality of gate drivers 2 drive gate bus lines (not shown) on the liquid crystal panel 4.

A terminal group of the source drivers 1 and the gate drivers 2 on a side of the liquid crystal panel 4 are electrically connected to a terminal group (not shown) composed of ITO on the liquid crystal panel 4 via wiring formed on the TCPs 3. These two terminal groups are electrically connected by means of thermo-compression bonding via an ACF, for example.

On the other hand, a terminal group of the source drivers 1 and the gate drivers 2 on a side of the flexible substrate 5 are electrically connected to wiring provided on the flexible substrate 5 by means of the ACF or soldering via the wiring formed on the TCPs 3.

In this way, a controller circuit 6 supplies display data signals (three kinds of signals of R·G·B) to the source drivers 1, and supplies kinds of control signals or power supplies (GND, VCC) to the source drivers 1 and the gate drivers 2 via the wiring on the flexible substrate 5 and the wiring on the TCPs 3.

Note that, in FIG. 4, for distinguishing each of the plurality of source drivers 1 and gate drivers 2, they are shown as an nth source driver S(n) (n is a positive integer) and a pth gate driver G(p) (p is a positive integer). In the present embodiment, the values are specified as $1 \leqq n \leqq 8$ and $1 \leqq p \leqq 2$, but not limited to these values.

A first source driver S(1) through an eighth source driver S(8), having an identical arrangement, receive the display data signals R·G·B, a start pulse signal SSPI, and a clock signal SCK, which are respectively outputted from the controller circuit 6. On the other hand, a first gate driver G(1) and a second gate driver G(2), respectively having an identical arrangement, receive a clock signal GCK and a start pulse signal GSPI from the controller circuit 6.

Furthermore, the liquid crystal panel 4 has 1024 pixels (the source side)×3 (RGB)×768 pixels (the gate side), for example. Therefore, the first source driver S(1) to the eighth source driver S(8) respectively display 64 tone gradations, and respectively drive 128 pixels×3 (RGB).

Figure 5:
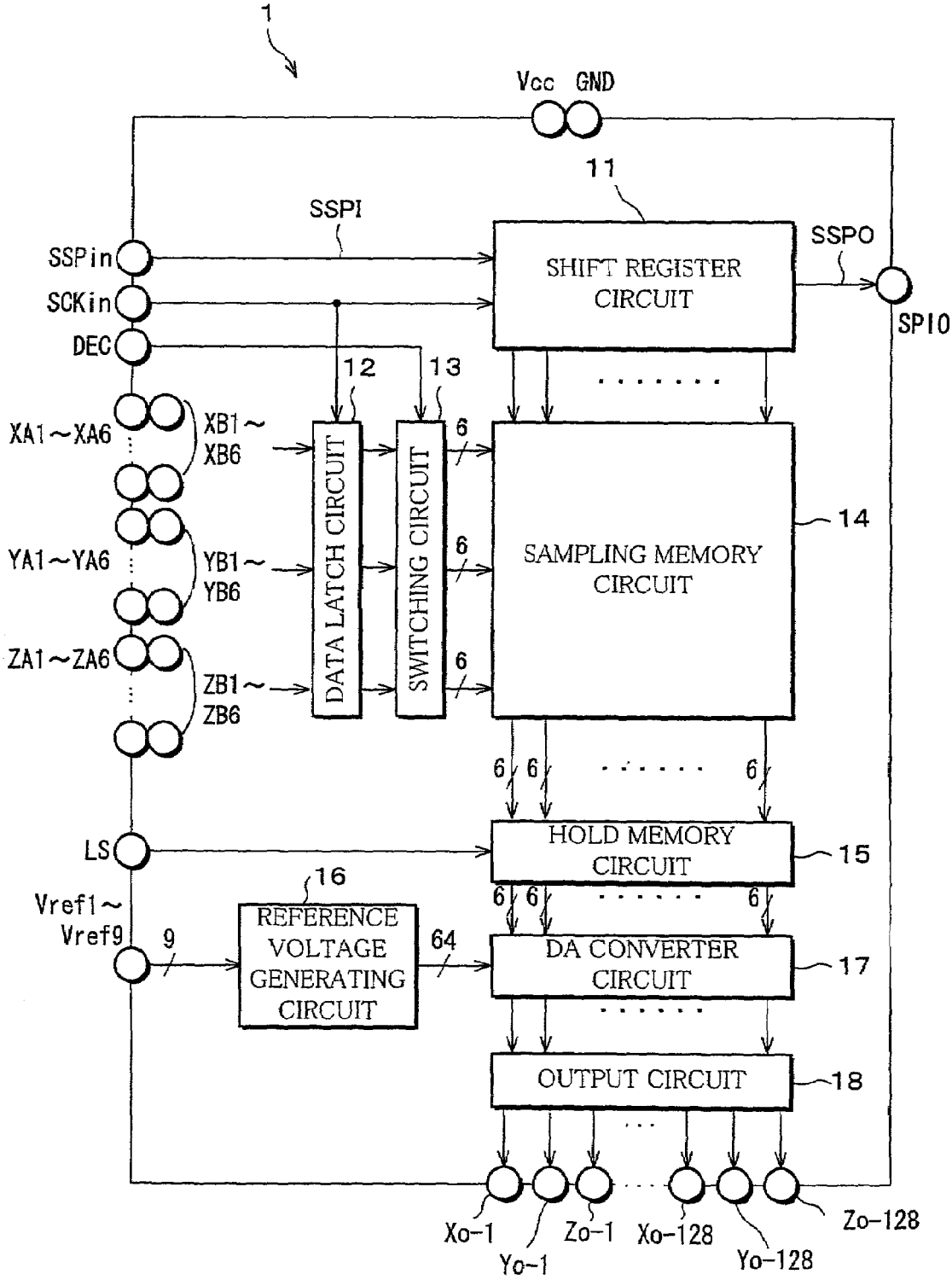
FIG. 5 is a circuit diagram showing an arrangement of the source driver of the present invention.
Figure 6:
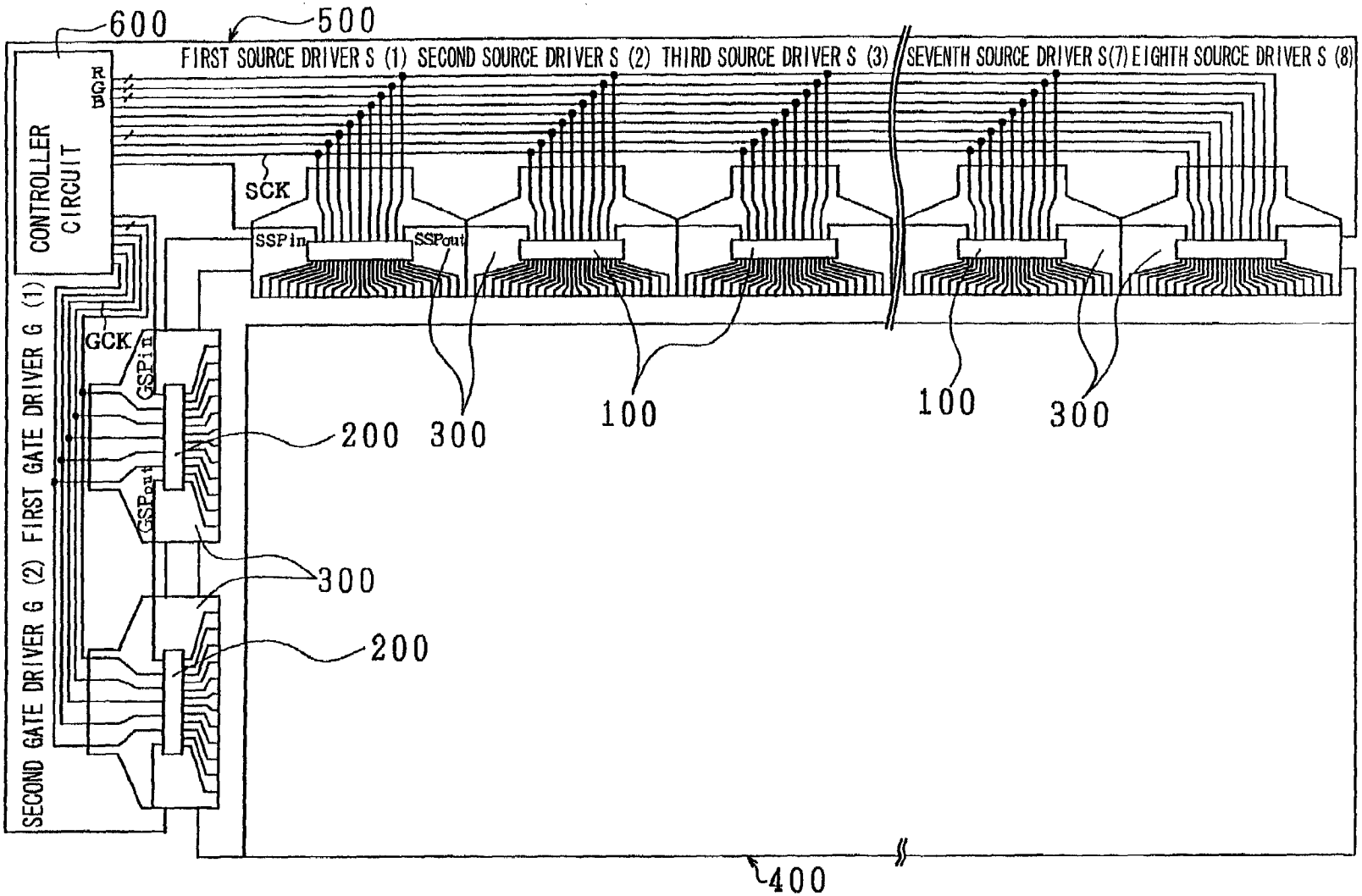
FIG. 6 is a circuit diagram showing an arrangement of a conventional display module.
Figure 7:
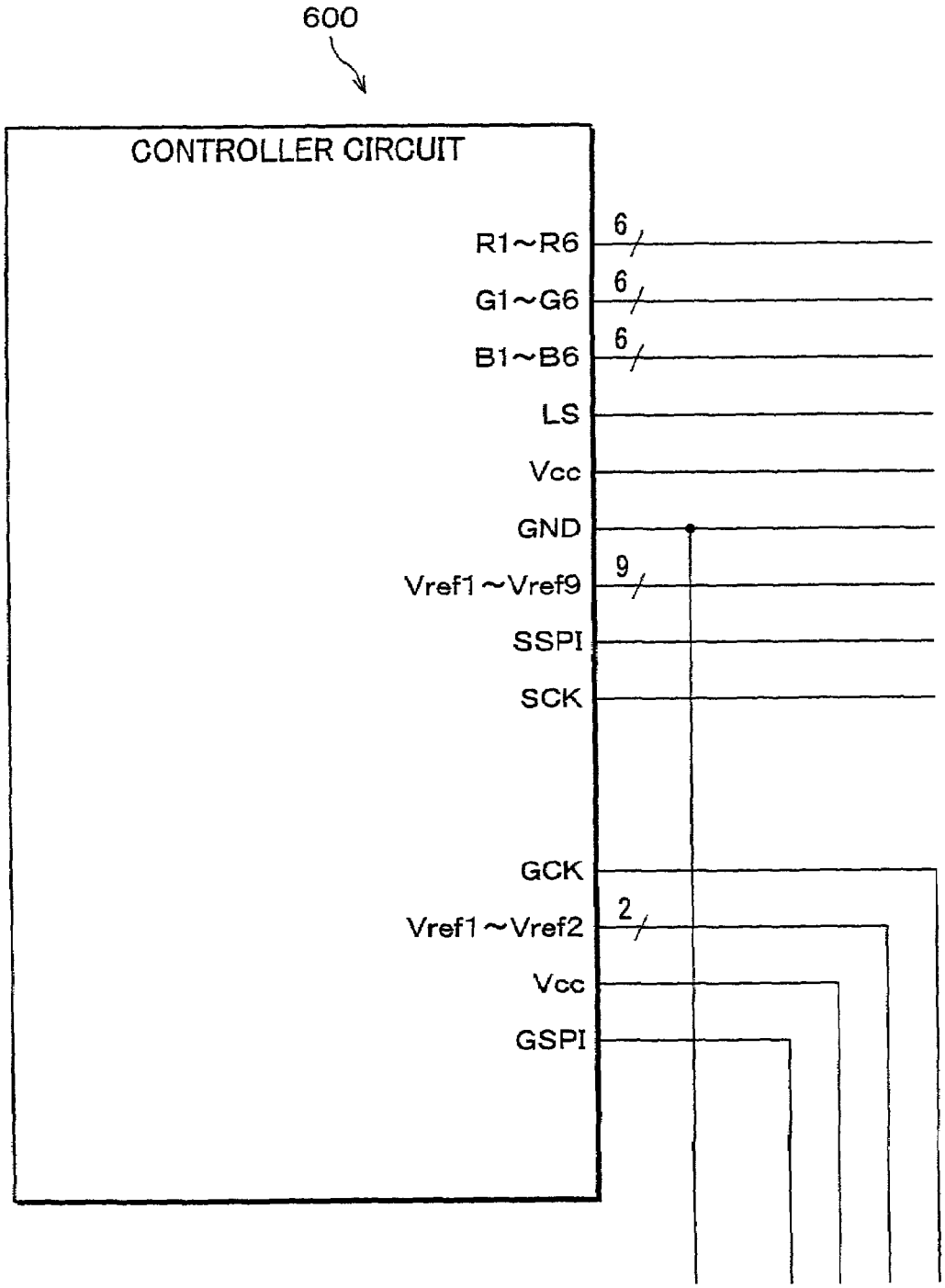
FIG. 7 is a circuit diagram of a controller circuit which is included in the conventional display module.

Next, a circuit configuration of the source driver 1 is explained, referring to FIG. 5.

As shown in FIG. 5, the source driver 1 includes a shift register circuit 11, a data latch circuit (data latch means) 12, a switching circuit (switching means) 13, a sampling memory circuit (sampling memory means) 14, a hold memory circuit 15, a reference voltage generating circuit 16, a DA converter circuit 17, and an output circuit 18.

Figure 8:
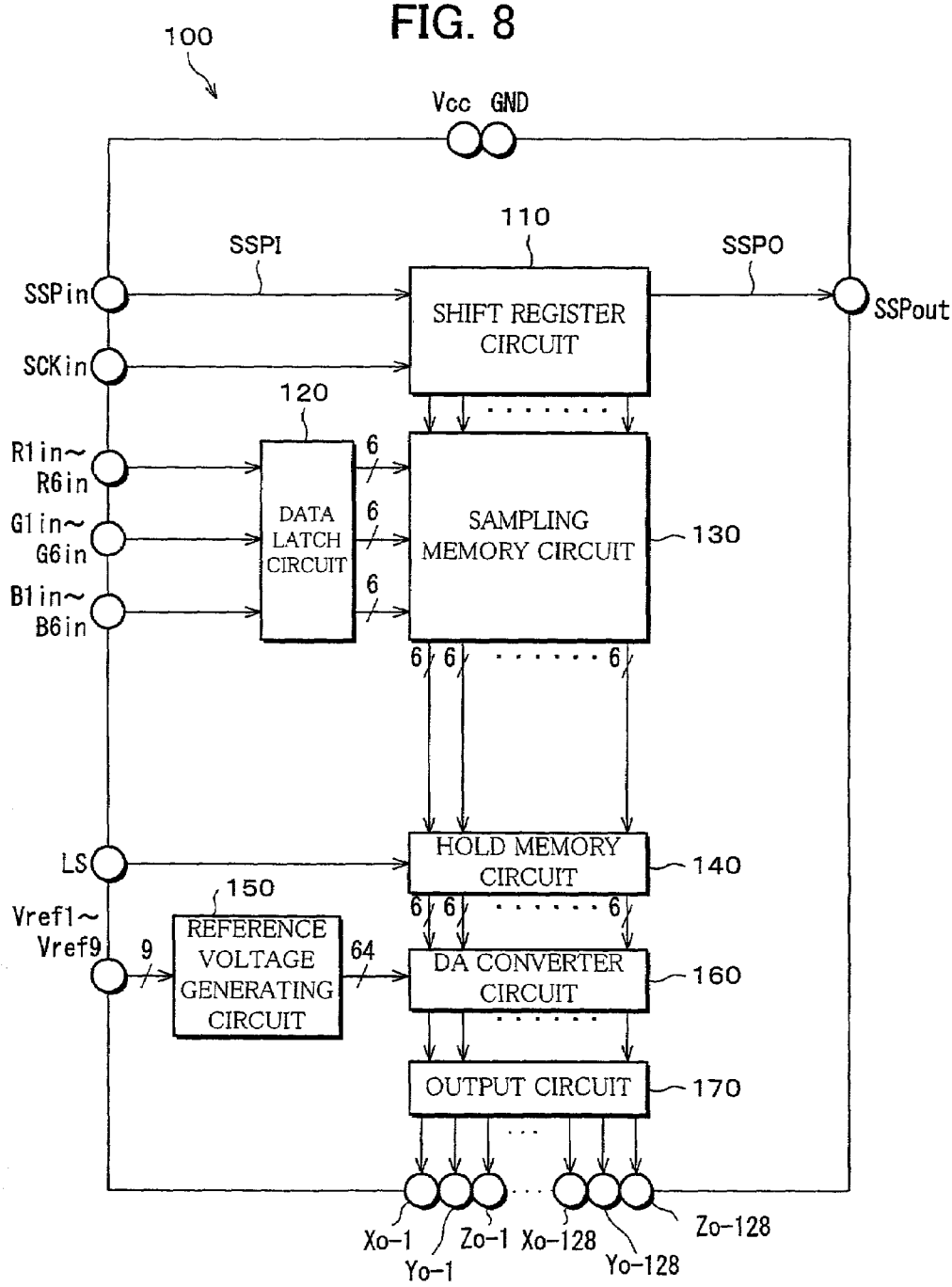
FIG. 8 is a circuit diagram showing an arrangement of a source driver as a drive unit which is included in the conventional display module.

Note that, the source driver 1 in the present embodiment basically has the same configuration and function as the source driver 100 which is explained referring to FIG. 8, except the following respects;

① the source driver 1 includes the switching circuit 13,

② the source driver 1 can receive the data either in a two-port single edge mode or in a dual edge mode as described later, ③ as input terminals for the display data signals, the source driver 1 includes (1) a port A group having a total of 18 terminals of XA1 to XA6 corresponding to the R signal, YA1 to YA6 corresponding to the G signal, and ZA1 to ZA6 corresponding to the B signal, and (2) a port B group having a total of 18 terminals of XB1 to XB6 corresponding to the R signal, YB1 to YB6 corresponding to the G signal, and ZB1 to ZB6 corresponding to the B signal.

④ the source driver 1 includes an input terminal for a switching control signal DEC which controls the switching circuit 13.

Therefore, following explanation mainly deals with respects that are different from the conventional source driver 100.

Note that, the two-port signal edge mode indicates a method of receiving data in synchronism with a rising edge or a falling edge of the clock signal, whereas the dual edge mode indicates a method of receiving data in synchronism with the rising and falling edges of the clock signal.

Figure 1:
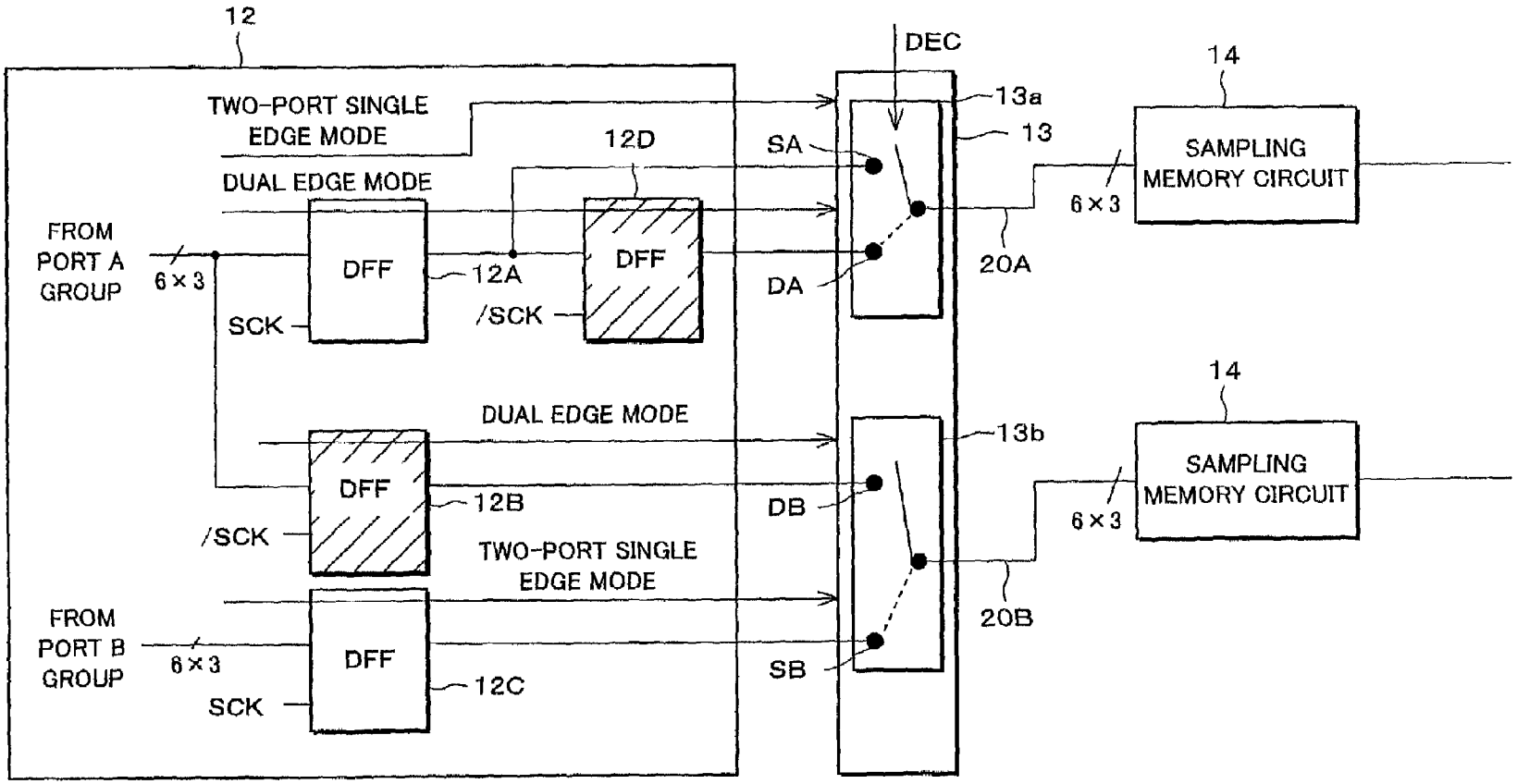
FIG. 1 is a circuit diagram showing an arrangement of a data latch circuit and a switching circuit, which are included in a source driver in accordance with an embodiment of a drive unit of the present invention.

First, detailed arrangements of the data latch circuit 12 and the switching circuit 13 are explained, referring to FIG. 1.

As shown in FIG. 1, the data latch circuit 12 includes four delayed flip-flops (hereinafter referred to as DFFs) as DFFs 12A to 12D per bit of the display data signals R·G·B.

The DFF 12A (data receiving means, a first latch circuit) receives the respective 6-bit display data signals R·G·B and the clock signal SCK from the port A group of the source driver 1. The DFF 12B (data receiving means, a second larch circuit) receives the display data signals R·G·B and an inverted clock signal/SCK inverted by an inverter (not shown). The DFF 12C (data receiving means) respectively receives the respective 6-bit display data signals R·G·B and the clock signal SCK from the port B group. The DFF 12D receives the respective 6-bit display data signals R·G·B and the inverted clock signal/SCK.

The switching circuit 13 switches the mode, in which the sampling memory circuit receives the display data signals, to one of the two-port single edge mode and the dual edge mode in accordance with the switching control signal DEC, and includes a switch element 13*a* having a terminal SA and a terminal DA, and a switch element 13*b* having a terminal DB and a terminal SB. The operation is explained as follows, where the switching circuit 13 switches the mode to the two-port single edge mode or the dual edge mode.

First, a case is explained where the switching circuit 13 switches the mode to the two-port single edge mode.

When the switching control signal DEC is a Low level, for example, the switch element 13*a* is switched to the terminal SA, whereas the switch element 13*b* is switched to the terminal SB. Furthermore, an even (or odd) number of 6-bit display data signals A·C·E . . . , which are supplied from the port A group, are received by the DFF 12A in synchronism with the rising edge of the clock signal SCK, and then sent to the sampling memory 14 via a data bus 20A.

Likewise, an even (or odd) number of the 6-bit display data signals B·D·F . . . , which are supplied from the port B group, are received by the DFF 12C in synchronism with the rising edge of the clock signal SCK, and then sent to the sampling memory circuit 14 via a data bus 20B.

Figure 2:
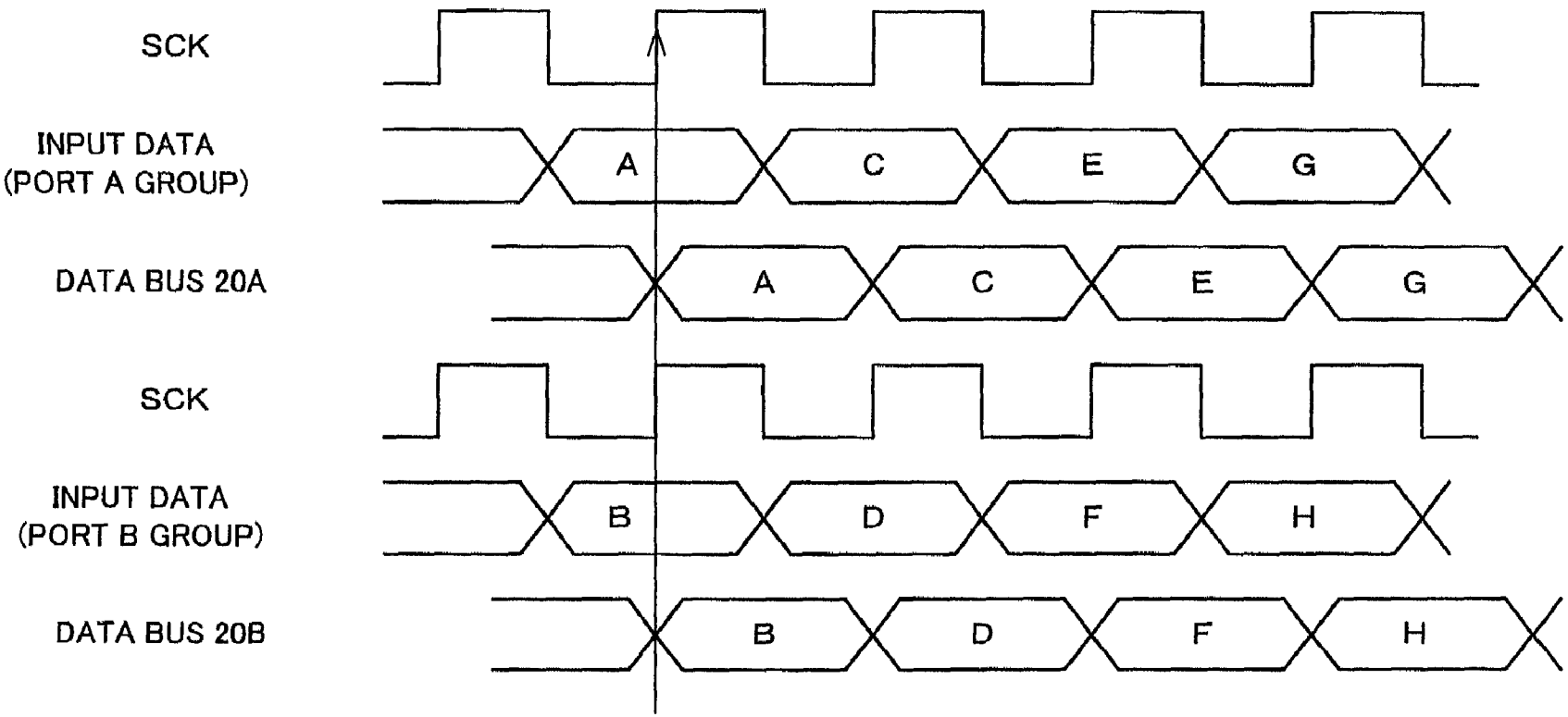
FIG. 2 is a timing chart showing how the data latch circuit in FIG. 1 receives display data signals in a two-port single edge mode.

By the way, as shown in FIG. 2, the display data signals A·C·E . . . from the port A group and the display data signals B·D·F . . . from the port B group are supplied from the controller circuit 6 (see FIG. 4) in synchronism with the identical edge. Therefore, the display data signals A and B from the data buses 20A and 20B are sent to the sampling memory circuit 14 in synchronism with the identical edge. Likewise, the display data signal C and the display data signal D and the like are sent to the sampling memory circuit 14 in synchronism with the identical edge.

As described above, when the switching control signal DEC is at the Low level, the display data signals A and B, C and D, and the like are received in the two-port single edge mode.

Next, a case is explained where the switching circuit 13 switches the mode to the dual edge mode.

Figure 3:
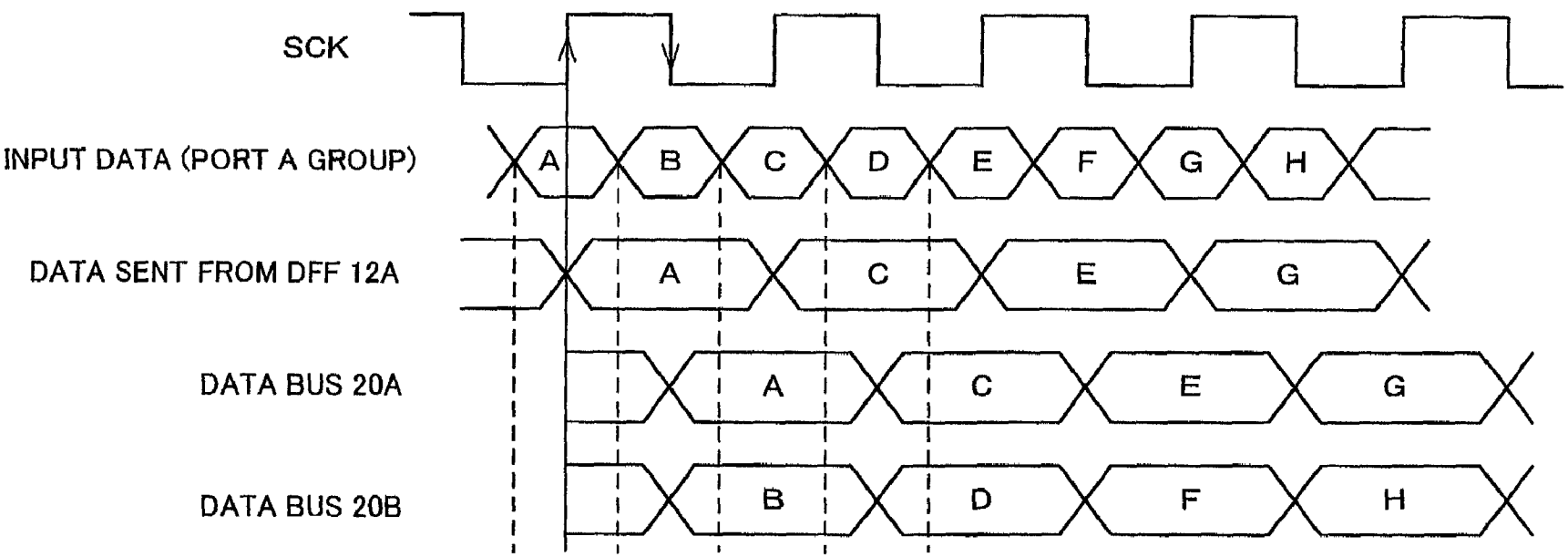
FIG. 3 is a timing chart showing how the data latch circuit in FIG. 1 receives the display data signals in a dual edge mode.

When the switching control signal DEC is at a High level, for example, the switch element 13*a* is switched to the terminal DA, whereas the switch element 13*b* is switched to the terminal DB. Then, as shown in FIG. 3, the consecutive display data signals A·B·C·D·E . . . are supplied from the port A group in synchronism with the rising and falling edges of the clock signal SCK.

Following this, the display data signals A·B·C·D·E . . . are sent to the DFF 12A. The DFF 12A selectively receives the display data signals A·B·C·D·E . . . in synchronism with the rising edge of the clock signal SCK.

Therefore, the display data signals A·B·C·D·E . . . are alternately received as the display data signals A·C·E . . . , and the alternately received display data signals A·C·E . . . are sent to the sampling memory circuit 14.

Following this, the DFF 12D receives the display data signals A·C·E . . . in synchronism with the falling edge of the clock signal SCK. Therefore, the DFF 12A and the DFF 12D output the display data signals A·C·E . . . to the sampling memory circuit 14 via the data bus 20A with a delay of a half cycle of the clock signal SCK with respect to a time when they are supplied to the controller circuit 6.

Furthermore, the DFF 12B selectively receives the display data signals B·D·F . . . among the display data signals A·B·C·D·E . . . in synchronism with the falling edge of the clock signal SCK.

Here, the display data signals B·D·F . . . are received in synchronism with the falling edge of the clock signal SCK, so as to be outputted with a delay of a half cycle of the clock signal SCK with respect to a time when they are supplied to the controller circuit 6.

In other words, the display data signals A·C·E . . . and the display data signals B·D·F . . . are supplied to the sampling memory circuit 14 in synchronism with the identical edge.

In this way, when the switching control signal DEC is at a High level, the display data signals A·B·C·D·E . . . are received in the dual edge mode.

Note that, the switching control signal DEC is controlled by the controller circuit 6. Alternatively, one of the two modes can be controlled in such a manner that the power supply VCC or GND line is connected to the terminal for the switching control signal DEC, at a point where the terminal for the switching control terminal DEC is connected to the TCP wiring, or in a vicinity of the flexible substrate. This eliminates the wiring for connecting the terminal for the switching control signal DEC with the controller circuit 6, thereby reducing the number of the wiring.

As described above, the data latch circuit 12 in the source driver 1 (the gate driver 2) of the present embodiment includes the DFFs 12A, 12B and 12D for receiving the display data signals R·G·B in synchronism with the rising and falling edges of the clock signal SCK having a half frequency of the display data signals R·G·B, and the DFFs 12A, 12B and 12D independently output to the sampling memory circuit 14 (a) the display data signals R·G·B received in synchronism with the rising edge of the clock signal SCK and (b) the display data signals R·G·B received in synchronism with the falling edge of the clock signal SCK.

According to the arrangement, even when each frequency of the display data signals R·G·B is high, the clock signal SCK for receiving the display data signals R·G·B can be set to have a half frequency of the display data signals R·G·B. This makes it easy to set timing of receiving the data.

Furthermore, the display data signals R·G·B received in synchronism with the rising edge and the display data signals R·G·B received in synchronism with the falling edge are independently sent to the sampling memory circuit 14 via the data buses 20A and 20B, respectively. In other words, the frequency of the display data signals R·G·B sent to the sampling memory circuit 14 is as half as the frequency of the display data signals R·G·B supplied to the DFFs 12A and 12B.

Therefore, a duty ratio of the data transfer clock in the source driver 1 can be maintained at a sufficient ratio so as not to degrade the image quality.

Note that, a circuit configuration in the source driver 1 is modified to respond to the display data signals R·G·B having a high frequency, so that there is no need to increase a port number for separating the display data signals R·G·B, thereby preventing the source driver 1 from becoming larger.

Therefore, it is possible to provide a small source driver 1, having high reliability in the display image quality, with respect to the display data signals R·G·B having a high frequency.

Moreover, the source driver 1 of the present embodiment includes a switching circuit 13 that can switch the DFFs 12A, 12B, 12C and 12D to perform one of functions of (a) receiving the display data signals R·G·B by the DFFs 12A, 12B and 12D, and (b) receiving the display data signals R·G·B by the DFFs 12A and 12C in synchronism with one of the rising and falling edges of the clock signal SCK having an identical frequency with the display data signals R·G·B which are supplied in two separated systems.

According to the arrangement, with using the switching circuit 13, the display data signals R·G·B can be received in such a manner that the DFFs 12A, 12B, 12C and 12D are switched to perform one of the functions of (a) receiving the display data signals R·G·B by the DFFs 12A, 12B and 12D (the dual edge mode) and (b) receiving the display data signals R·G·B by the DFFs 12A and 12C in synchronism with one of the rising and falling edges of the clock signal SCK having the identical frequency with the display data signals R·G·B which are supplied in two separated systems (the two-port single edge mode).

Figure 9:
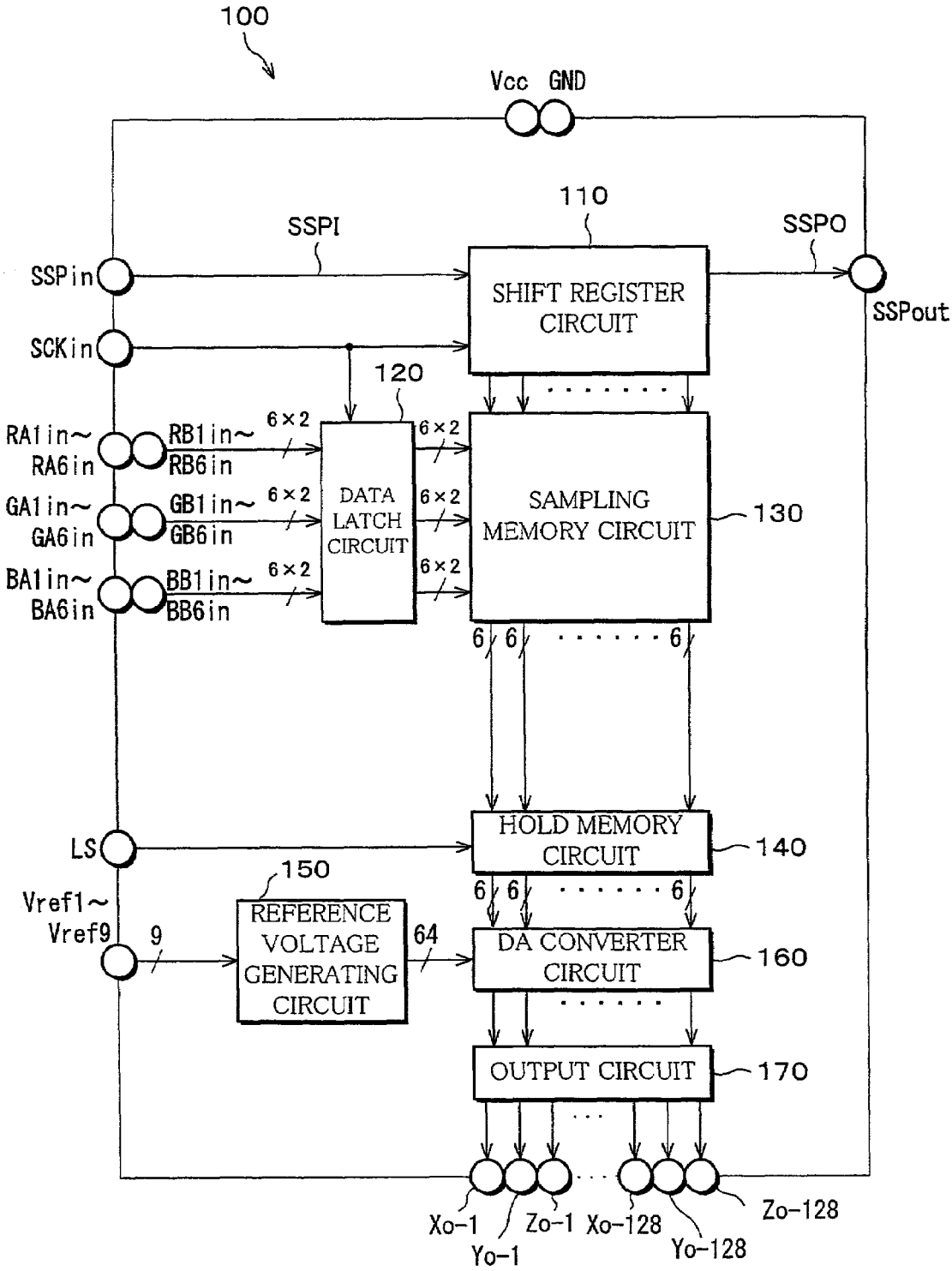
FIG. 9 is a circuit diagram showing another arrangement example of the conventional display module.

Here, the two-port single edge mode is realized by the conventional source driver 100 (the gate driver 200) as shown in FIG. 9, for example.

Therefore, in comparison to the conventional source driver for realizing the two-port single edge mode, in a simple arrangement in which the DFFs 12A, 12B and 12D and the switching circuit 13 are provided, it is possible to easily provide the source driver 1 having high reliability in the display image quality with respect to the display data signals R·G·B having a high frequency.

Furthermore, in the arrangement, the conventional source driver for realizing the two-port single edge mode can be used and a design of the flexible substrate 5 needs not be modified, thereby reducing the cost of the display module.

Moreover, the source driver 1 of the present embodiment includes (a) the DFF 12A for receiving the display data signals R·G·B in synchronism with the rising edge of the clock signal SCK having a half frequency of the display data signals R·G·B, (b) the DFF 12B for receiving the display data signals R·G·B in synchronism with the falling edge of the clock signal SCK, and for outputting the display data signals R·G·B to the sampling memory circuit 14, and (c) the DFF 12D for receiving the display data signals R·G·B, which are received by the DFF 12A, in synchronism with the identical falling edge with the DFF 12B, and for outputting the display data signals R·G·B to the sampling memory circuit 14.

According to the arrangement, the DFF 12B and the DFF 12D output the display data signals R·G·B to the sampling memory circuit 14 in synchronism with the identical edge.

In other words, the display data signals R·G·B received in synchronism with the rising edge of the clock signal SCK and the display data signals R·G·B received in synchronism with the falling edge of the clock signal SCK are sent to the sampling memory circuit 14 in synchronism with the identical edge.

This can reduce the time for collecting the display data signals R·G·B of one horizontal synchronization period, thereby simplifying processing in the source driver 1.

Moreover, the display module of the present embodiment includes the source driver 1 of the arrangement.

According to the arrangement, the display module includes the source driver 1 having high reliability in display image quality with respect to the display data signals R·G·B having a high frequency.

Therefore, it is possible to provide a display module that can display an image without degrading the image quality with respect to the display data signals having a high frequency.

Note that, the drive unit of the present invention may include switching means for switching the data receiving means so as to perform one of functions of (a) receiving the display data signals in synchronism with the rising and falling edges of the clock signal having a half frequency of the display data signals, and (b) receiving the display data signals in synchronism with one of rising and falling edges of the clock signal having an identical frequency with the display data signals which are supplied in two separated systems.

According to the arrangement, with using the switching means, the display data signals can be received in such a manner that the data receiving means is switched to perform one of the functions of (a) receiving the display data signals in synchronism with the rising and falling edges of the clock signal having a half frequency of the display data signals (the dual edge mode) and (b) receiving the display data signals in synchronism with one of the rising and falling edges of the clock signal having the identical frequency with the display data signals which are supplied in two separated systems (the two-port single edge mode).

Here, the two-port single edge mode is realized by the conventional drive unit as shown in FIG. 9, for example.

Therefore, in comparison to the conventional drive unit for realizing the two-port single edge mode, in a simple arrangement in which the data receiving means and the switching means are provided, it is possible to easily provide the drive unit having high reliability in the display image quality with respect to the display data signals having a high frequency.

Furthermore, in addition to the effects of the drive unit of the arrangement, the conventional drive unit for realizing the two-port single edge mode can be used and a design of the flexible substrate needs not be modified, thereby reducing the cost of the display module.

Moreover, the drive unit of the present invention may be so arranged that the data latch means includes a first latch circuit for receiving the display data signals in synchronism with one of the rising and falling edges of the clock signal having a half frequency of the display data signals, a second latch circuit for receiving the display data signals in synchronism with the other of the rising and falling edges, and for outputting the display data signals to the sampling memory means, and a third latch circuit for receiving the display data signals received by the first latch circuit in synchronism with the identical edge with the second latch circuit, and for outputting the display data signals to the sampling memory means.

According to the arrangement, the third latch circuit receives the display data signals received by the first latch circuit in synchronism with the identical edge with the second latch circuit and outputs the display data signals to the sampling memory means in synchronism with the identical edge. Therefore, the second latch circuit and the third latch circuit output the display data signals to the sampling memory means in synchronism with the identical edge.

In other words, the display data signals received in synchronism with the rising edge of the clock signal and the display data signals received in synchronism with the falling edge of the clock signal are sent to the sampling memory means in synchronism with the identical edge.

This can reduce the time for collecting the display data signals of the one horizontal synchronization period, thereby simplifying processing in the drive unit, in addition to the effects of the drive unit of the foregoing arrangement.

Note that, a drive unit of the present invention may include data receiving means for receiving inputted display data signals in synchronism with respective rising and falling edges of a clock signal having a half frequency of the display data signals, and sampling memory means for storing the display data signals received by the data receiving means so as to drive a display module in accordance with the display data signals, wherein the data receiving means independently outputs to the sampling memory means (a) the display data signals received in synchronism with the rising edge of the clock signal and (b) the display data signals received in synchronism with the falling edge of the clock signal.

Moreover, the drive unit of the present invention may be so arranged to be further provided with switching means for switching the data receiving means so as to perform one of functions of (a) receiving the display data signals in synchronism with the rising and falling edges of the clock signal having a half frequency of the display data signals, and (b) receiving the display data signals in synchronism with one of rising and falling edges of a clock signal having an identical frequency with the display data signals which are supplied in two separated systems.

Moreover, the drive unit of the present invention may be so arranged to be further provided with a first latch circuit for receiving the display data signals in synchronism with one of the rising and falling edges of the clock signal having a half frequency of the display data signals, a second latch circuit for receiving the display data signals in synchronism with the other of the rising and falling edges, and for outputting the display data signals to the sampling memory means, and a third latch circuit for receiving the display data signals received by the first latch circuit in synchronism with the identical edge with the second latch circuit, and for outputting the display data signals to the sampling memory means.

Note that, the drive unit of the present invention which drives the display module in accordance with the display data signals may be so arranged that the drive unit includes (a) transfer means for transferring the start pulse signal in accordance with the clock signal, (b) latch means for receiving the inputted display data signals in synchronism with the data transfer clock signal and for outputting the display data signals as synchronization data, and (c) sampling means for sampling the synchronization data in accordance with the transferred start pulse signal, and for outputting the synchronization data, wherein the latch means includes (1) means for receiving the display data signals in synchronism with one of the rising and falling edges of the clock signal, and (2) means for receiving the display data signals in synchronism with the rising and falling edges of the clock signal, wherein the switching means supplies one of the display data signals from the latch means to the sampling memory.

According to the drive unit of the arrangement, even when the transfer rate of the display data becomes higher because the display screen will become larger or will have higher definition, it is possible to provide the drive unit of a display apparatus having high reliability, which can obtain a margin for receiving the data, and which can be easily designed. Furthermore, the display module designed in the conventional technique (the two-port type in FIG. 9) can use the drive unit having the arrangement without modifying the flexible substrate or a tape carrier substrate, thereby facilitating replacement of the drive unit. This also increases the number of the drives to be used, so that it is expected to get benefit from quantity production of the drive units, thereby reducing the cost. Furthermore, it can be realized with adding a simple circuit, thereby not causing a chip size of the source driver to greatly increase.

Moreover, the drive unit of the present invention may be so arranged that (1) one of the latch means has (a) a first latch circuit for receiving the display data signals in synchronism with one of the rising and falling edges of the clock signal and (b) a second latch circuit for arranging again the data from the first latch circuit and setting timing of the data, and (2) the other latch means has a third latch circuit for receiving the display data signals in synchronism with the rising and falling edges of the clock signal, wherein the switching circuit selects one of the latch means in response to the switching element so as to supply the display data signals to the sampling memory.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A drive unit, comprising:

a data latch circuit receiving inputted display data signals in response to a clock signal; and a sampling memory circuit sampling display data signals from the data latch circuit and storing the display data signals received by the data latch circuit, the drive unit driving a display module in accordance with the display data signals stored by the sampling memory circuit, wherein the data latch circuit receives the display data signals in response to respective rising and falling edges of the clock signal, the clock signal having a half frequency of the display data signals, and independently outputs to the sampling memory circuit the display data signals received in response to the rising edge of the clock signal and the display data signals received in response to the falling edge of the clock signal.

2. The drive unit as set forth in claim 1, further comprising:

a switching circuit switching the display data signals received to perform at least one function of receiving the display data signals in synchronism with the rising and falling edges of the clock signal having a half frequency of the display data signals, and receiving the display data signals in synchronism with one of rising and falling edges of the clock signal having an identical frequency with the display data signals which are supplied in two separated systems.

3. The drive unit as set forth in claim 1, wherein the data latch circuit includes:

a first latch circuit for receiving the display data signals in response to one of the rising and falling edges of the clock signal having a half frequency of the display data signals;

a second latch circuit for receiving the display data signals in response to the other of the rising and falling edges, and for outputting the display data signals to the sampling memory means, and a third latch circuit for receiving the display data signals received by the first latch circuit in response to the identical edge with the second latch circuit, and for outputting the display data signals to the sampling memory means.

4. A drive unit, comprising:

data receiving means for receiving inputted display data signals in response to respective rising and falling edges of a clock signal having a half frequency of the display data signals; and sampling memory means for sampling display data signals from the data receiving means and storing the display data signals received by the data receiving means so as to drive a display module in accordance with the display data signals, wherein the data receiving means independently outputs to the sampling memory means the display data signals received in response to the rising edge of the clock signal and the display data signals received in response to the falling edge of the clock signal.

5. The drive unit as set forth in claim 4, further comprising:

switching means for switching the data receiving means so as to perform at least one function of receiving the display data signals in synchronism with the rising and falling edges of the clock signal having a half frequency of the display data signals, and receiving the display data signals in synchronism with one of rising and falling edges of a clock signal having an identical frequency with the display data signals which are supplied in two separated systems.

6. The drive unit as set forth in claim 4, further comprising:

a first latch circuit for receiving the display data signals in response to one of the rising and falling edges of the clock signal having a half frequency of the display data signals;

a second latch circuit for receiving the display data signals in response to the other of the rising and falling edges, and for outputting the display data signals to the sampling memory means, and a third latch circuit for receiving the display data signals received by the first latch circuit in response to the identical edge with the second latch circuit, and for outputting the display data signals to the sampling memory means.

7. A display module, which is driven by a drive unit comprising:

data latch means for receiving inputted display data signals in response to a clock signal, and sampling memory means for sampling display data signals from the data latch means and storing the display data signals received by the data latch means so as to drive the display module, wherein the data latch means includes data receiving means for receiving the display data signals in response to respective rising and falling edges of a clock signal having a half frequency of the display data signals, and the data receiving means independently outputs to the sampling memory means the display data signals received in response to the rising edge of the clock signal and the display data signals received in response to the falling edge of the clock signal.

* * * * *